US007666264B2

(12) United States Patent
Britton

(10) Patent No.: US 7,666,264 B2
(45) **Date of Patent: *Feb. 23, 2010**

(54) AIRCRAFT CLEANER FORMULA

(75) Inventor: Claudia E. Britton, Schenectady, NY (US)

(73) Assignee: Spray Nine Corporation, Johnstown, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/686,597

(22) Filed: Mar. 15, 2007

(65) Prior Publication Data

US 2007/0155641 A1 Jul. 5, 2007

Related U.S. Application Data

(63) Continuation of application No. 11/324,348, filed on Jan. 3, 2006, now Pat. No. 7,271,136.

(60) Provisional application No. 60/646,017, filed on Jan. 21, 2005.

(51) Int. Cl.

| | |
|---|---|
| ***B08B 3/04*** | (2006.01) |
| ***C11D 1/72*** | (2006.01) |
| ***C11D 3/08*** | (2006.01) |
| ***C11D 3/22*** | (2006.01) |

(52) U.S. Cl. ..... 134/41; 134/2; 134/39; 134/40; 134/42; 510/109; 510/189; 510/245; 510/255; 510/258; 510/421; 510/437; 510/466; 510/467; 510/474

(58) Field of Classification Search ..... 510/109, 510/189, 245, 255, 258, 421, 437, 466, 467, 510/474; 134/2, 39, 40, 41, 42

See application file for complete search history.

(56) References Cited

U.S. PATENT DOCUMENTS

| | | | | |
|---|---|---|---|---|
| 4,770,803 | A | 9/1988 | Forsberg | |
| 5,413,727 | A | 5/1995 | Drapier et al. | |
| 5,427,707 | A | 6/1995 | Drapier et al. | |
| 5,837,666 | A | 11/1998 | Murata et al. | |
| 5,858,957 | A | 1/1999 | Donoghue et al. | |
| 5,880,078 | A | 3/1999 | Bevilacqua, Jr. et al. | |
| 5,916,372 | A * | 6/1999 | Bevilacqua et al. | 134/6 |
| 6,001,793 | A | 12/1999 | Figdore et al. | |
| 6,211,139 | B1 | 4/2001 | Keys et al. | |
| 6,376,455 | B1 | 4/2002 | Friedli et al. | |
| 6,458,343 | B1 | 10/2002 | Zeman et al. | |
| 7,271,136 | B2 * | 9/2007 | Britton | 510/109 |
| 2004/0266658 | A1 * | 12/2004 | Lenhart | 510/505 |
| 2006/0166854 | A1 * | 7/2006 | Britton | 510/470 |

OTHER PUBLICATIONS

Dow Corning, Q1-6083, Antifreeze Additive, Apr. 7, 2004, Ref. No. 26-1223-01, United States of America.

Tiger Chemical Company, Surfactant Guide & Formulary, 1997 Addition, Australia.

* cited by examiner

*Primary Examiner*—Brian P Mruk

(74) *Attorney, Agent, or Firm*—Heslin Rothenberg Farley & Mesiti P.C.

(57) ABSTRACT

A cleaning composition based on an aqueous or non-petroleum solvent, and useful for cleaning exterior surfaces such as aircraft exterior surfaces and other metal, glass, rubber and polymer surfaces possesses solvent-like properties with respect to greasy soils; inhibits corrosion and degradation of rubber; is biodegradable; forms a stable emulsion with water; remains optically clear and stable at multiple dilutions with water; and conforms to MIL-PRF 87937D. The composition includes at least one fatty acid methyl ester, at least one ethoxylated alcohol having an HLB ranging from about 10 to about 14, at least one alkyl polyglycoside having an HLB ranging from about 10 to about 14, at least one hydrotrope, an alkali metal silicate, at least one corrosion inhibitor in an amount effective to prevent corrosion on metals, and water.

18 Claims, No Drawings

AIRCRAFT CLEANER FORMULA

CROSS-REFERENCE TO RELATED APPLICATIONS

This application claims priority from U.S. Utility patent application Ser. No. 11/324,348 filed on Jan. 3, 2006, now U.S. Pat. No. 7,271,136, the entire contents of which are incorporated herein by reference, and which claims priority from U.S. Provisional Application Ser. No. 60/646,017, filed on Jan. 21, 2005, the entire contents of which are incorporated herein by reference.

BACKGROUND OF THE INVENTION

A cleaning composition useful for cleaning exterior surfaces such as aircraft exterior surfaces and other metal, glass, rubber and polymer surfaces should possess solvent-like properties with respect to greasy soils, and should inhibit corrosion and degradation of metal surfaces. Although a number of commercially available cleaning compositions possess these two properties, few have passed the stringent tests necessary for military specification MIL-PRF-87937D status. To achieve the mil-spec status, a cleaning composition must, in addition to having a de-greasing effect, have a cleaning efficiency of 90% of that of a military control test formula, a corrosion inhibiting effect on metal surfaces outlined in the mil-spec, and a pH of less than 10; be biodegradable; be based on an aqueous and water dilutable formula; form a stable solution or micro-emulsion with water; and remain optically clear and stable at a dilution ratio of 1 to 10 with water. Clarity upon dilution is required because a visual determination of cleaning, for example with respect to an aircraft canopy, is most important in a military application. For ease of transport, the cleaning compound must be a highly dilutable concentrate. MIL-PRF-87937D is incorporated herein by reference, and Table I and Table II of MIL-PRF-87937D are reproduced herein. Independent testing by Scientific Material International Inc. (SMI, Inc.) confirmed the cleaning compound conformed to MIL-PRF-87937D, the overall test results which are reproduced herein as Table 5. More specific, detailed results are provided for the relevant, individual tests (i.e. chemical requirements, physical properties, effect on metals, etc.) at Table 6.

Among aqueous-based cleaning compositions effective as de-greasing agents, lack of clarity upon dilution with water combined with corrosive activity of the composition remain a common, unsolved problem. To be effective as a degreaser, a cleaner may contain an oil or a fatty acid ester. Among the products that have achieved MIL-PRF 87937D status, one product appears to contain an oil additive. However, when such products are diluted according to the mil-spec, the resultant solution is opaque and milky-white.

Thus, a need exists for an aqueous-based, biodegradable, cleaning composition that is effective as a de-greasing agent, anti-corrosive, forms a clear and stable emulsion with water; and remains optically clear and stable at multiple dilution ratios with water.

SUMMARY OF THE INVENTION

The present invention relates to the discovery of a cleaning micro-emulsion that is optically clear at multiple dilutions, stable over time, and has anti-corrosive activity. As such, the present invention relates to cleaning compositions that may include, for example, a cleaning composition suitable for the exterior surfaces of aircraft. In another aspect, the invention relates to methods of making and to methods of using the cleaning compounds according to an embodiment of the invention. Because a visual determination of cleaning is most important in a military application, in particular for cleaning the canopy of an aircraft, a clear dilution product is far superior to an opaque and milky-white solution.

The inventive composition shows unexpected results for cleaning performance, stability upon dilution with water, and corrosion inhibition over prior art formulations presently commercially available. A cleaning composition according to an embodiment of the invention is a blend that imparts stabilization of the formula, defoaming and corrosion inhibition. The resultant product is a clear and stable cleaning and degreasing micro-emulsion with the following unique attributes: Non-petroleum solvent-based, a cleaning composition according to the invention includes a fatty acid ester, for example, methyl oleate, which possesses solvent-like properties on greasy soils, an organic polysaccharide, alcohol ethoxylates, and an amide, an amine, or a mixture thereof Methyl oleate, that, alone, is immiscible in water, forms a clear, stable, microemulsion in water when combined with other ingredients according to certain ratios, as described below in the Detailed Description and the Examples. The fatty acid ester that, alone, is non-miscible with water, is combined with other organic surfactants in such a ratio that the fatty acid ester forms a clear and stable concentrated micro-emulsion in water. The resultant product is a blend that remains both optically clear and stable at multiple dilution ratios with water. The product contains a blend of water-soluble multi-metal corrosion prevention additives that allow the product to be efficacious for many metal surfaces without the hazard of corrosion damage.

In one aspect, therefore, the present invention relates to a cleaning composition that includes

- 1 to 10 parts by weight of at least one fatty acid methyl ester;
- 10-35 parts by weight of at least one ethoxylated alcohol having an HLB ranging from about 10 to about 14;
- 1 to 10 parts by weight of at least one alkyl polyglycoside having an HLB ranging from about 10 to about 14;
- 1 to 25 parts by weight of at least one hydrotrope;
- 0.1 to 1 parts by weight of an alkali metal silicate;
- 0.1 to 2 parts by weight of at least one corrosion inhibitor in an amount effective to prevent corrosion on metals; and
- 30 to 1000 parts water.

The composition has pH greater than about 9.5, preferably between about 9.5 and 10, is non-toxic and biodegradable, and the fatty acid methyl ester is preferably methyl oleate.

DETAILED DESCRIPTION OF THE INVENTION

A cleaning composition according the present invention includes 1 to 10 parts by weight of at least one fatty acid methyl ester; 10 to 35 parts by weight of at least one ethoxylated alcohol having an HLB ranging from about 10 to about 14; 1 to 10 parts by weight of at least one alkyl polyglycoside having an HLB ranging from about 10 to about 14; 1-25 parts by weight of at least one hydrotrope; 0.1 to 1 parts by weight of an alkali metal silicate; 0.1 to 2 parts by weight of at least one corrosion inhibitor in an amount effective to prevent corrosion on metals; and 20 to 1000 parts water. The composition is non-toxic and biodegradable.

The fatty acid methyl ester is used at about 1 to 10 parts by weight in the cleaning compositions. It possesses solvent-like properties on greasy soils, and assists in lifting the grease or soil from a surface so that the surfactants in the cleaning composition can more easily emulsify the soil particles. The amount of fatty acid methyl ester may be limited to about 2 to about 5 parts by weight in some embodiments. Methyl oleate is a preferred fatty acid methyl ester. The esters are generally immiscible in water, and are combined with the surfactants in such a ratio that a clear and stable concentrated micro-emulsion is formed. The ratio of the fatty acid methyl ester to the total amount of ethoxylated alcohols and alkyl polyglycoside typically ranges from about 1 part fatty acid methyl ester to about 2 parts surfactant to about 1 part fatty acid methyl ester to about 12 parts surfactant depending upon the individual chemical properties of each ingredient. In a preferred embodiment, the fatty acid methyl ester is combined at a 1:10 ratio with the surfactants. The resultant product is a blend that remains both optically clear and stable at multiple dilution ratios with water.

The cleaning compositions include at least one ethoxylated alcohol having an HLB ranging from about 10 to about 14 and at least one alkyl polyglycoside having an HLB ranging from about 10 to about 14 as surfactants. The HLB of the surfactants preferably ranges from about 11 to about 13. HLB (Hydrophilic/Lipophilic Balance) is a measure of the surfactant's affinity for water or oil, and is calculated based on its molecular structure. Surfactants having an HLB ranging from 10 to 14 are generally useful for emulsifying oil in an aqueous continuous phase.

The ethoxylated alcohols are employed in an amount ranging from about 10 to 35 parts by weight, preferably 15 to 30 parts by weight, more preferably 15 to 25 parts by weight, in the cleaning compositions of the present invention. They include linear alcohol ethoxylates and ethoxylated fatty alcohols having an HLB of 10 to 14; alkyl phenol ethoxylates having an HLB ranging from 10 to 14 may also be used. Preferred ethoxylated alcohols for use in the compositions of the present invention include C6-C8 ethoxylated alcohols, C8-C10 ethoxylated alcohols, C9-C11 ethoxylated alcohols, C12-C16 ethoxylated fatty alcohols and combinations thereof Alkyl phenol ethoxylates may be used in applications where potential toxicity of the compositions or their by-products in the environment is not a concern. For cleaning compositions that conform to MIL-PRF-87937D, the ethoxylated alcohols are linear alcohol ethoxylates, specifically a blend of a C8-C10 ethoxylated alcohol and a C9-C11 ethoxylated alcohol. An example of a commercially available product containing a C8-C10 ethoxylated alcohol having an HLB ranging from about 10 to about 14 is ALFONIC® 810-4.5 (CONDEA VISTA Company, Houston, Tex.). An example of a commercially available product containing a C9-C11 ethoxylated alcohol and having an HLB ranging from about 10 to about 14 is TOMADOL 91-6 (Tomah Reserve, Inc., Reserve, La.). An example of a commercially available product containing a C6-C8 ethoxylated alcohol having an HLB ranging from about 10 to about 14 is ALFONIC® 610-3.5 (CONDEA VISTA). An example of a commercially available product containing a C12-C14 ethoxylated fatty alcohol having an HLB ranging from about 10 to about 14 is GENAPOL 26 L 60 (Clariant Corporation, Charlotte, N.C.). Examples of commercially available products containing an alkyl polyglycoside having an HLB ranging from about 10 to about 14 is AG 6206 from Akzo Nobel Surface Chemistry, Chicago, Ill. and GLUCOPON 225 DK from Cognis Corporation, Cincinnati, Ohio. In preferred embodiments, the cleaning compositions contain from about 10 to about 25 parts by weight, preferably 10 to 15 parts by weight, of the C9-C11 ethoxylated alcohol, and about 1 to about 15 parts by weight, preferably 2 to 10 parts by weight, of the C8-C10 ethoxylated alcohol.

A hydrotrope for use in the cleaning compositions of the present invention is employed in an amount ranging from about 1-25 parts by weight, preferably about 5-20 parts by weight, more preferably about 5 to 15 parts by weight. The hydrotrope preferably includes an alkanolamide, particularly capramide diethanolamine. Commercially available products containing capramide diethanolamine are MONAMID 150-CW from Uniqema, New Castle, Del., and Colamid HPC from Colonial Chemicals, S. Pittsburg, Tenn. Sodium xylene sulfonate may be included in place of or in addition to the alkanolamide where compliance with MIL-PRF-87937D is not necessary.

The alkali metal silicate such as potassium silicate, sodium silicate or sodium disilicate, which provides alkalinity and corrosion resistance, is employed in an amount ranging from about 0.1 to 1 parts by weight, preferably about 0.1 to 0.5 parts by weight, in the composition. The alkali metal silicate for use in the cleaning compositions is preferably sodium disilicate, and more preferably liquid sodium disilicate. The sodium silicate is generally added in the form of an aqueous solution, preferably having a $Na_2O:SiO_2$ ratio ranging from about 1:1.3 to 1:2.8. Although the alkali metal of the alkali metal silicates, alkali metal carbonates and alkali metal hydroxides is preferably sodium, the corresponding potassium compounds, or mixtures of sodium and potassium compounds, or mixtures of sodium and potassium compounds can also be used. Commercially available products containing sodium silicate are D® (PQ Corporation Valley Forge, Pa.) (liquid) and SOD SILICATE 50 DEG BE (Ashland Specialty Chemicals, Columbus, Ohio). Sodium Metasilicate (sodium metasilicate pentahydrate), sold as METSO PENTABEAD 20 by PQ Corporation may also be included.

The cleaning compositions may additionally contain 0.01 to 1 parts by weight of an alkali metal hydroxide, preferably 0.05 to 1 parts by weight, preferably 0.05 to 0.5 parts by weight, for example, sodium or potassium hydroxide. It should be noted that pH of the cleaning composition is greater than about 9.5, and preferably less than about 10, in order to minimize darkening of aluminum metal surfaces, but in applications where metal corrosion is not a concern, pH may be greater than about 10, preferably about 12.

One or more corrosion inhibitors are used in the cleaning composition in amounts effective to prevent corrosion on metals, preferably 0.05 to 2 parts by weight, preferably about 0.08 to about 0.8 parts by weight, for each inhibitor. Preferred corrosion inhibitors for use in the cleaning compositions are modified carboxylic acid derivatives sold as under the DeCORE and DeTROPE tradenames by DeForest. Enterprises, Boca Raton, Fla., DeCORE IMT-100LF and DeTROPE CA-100 are particularly useful. Phosphate esters such as DePhos HP 739 may be used as a corrosion inhibitor in the compositions, and may also function as a hydrotrope therein.

The cleaning composition may also include minor amounts (that is, about 0.01 to 1 parts by weight) of additives such as a preservative and/or a phosphonate-functional alkylsodium siliconate. A preferred preservative is hexahydro-1,3,5-tris(2-hydroxyethyl)-s-triazine, sold as SURCIDE P by Surety Laboratories, Cranford, N.J. The phosphonate-functional alkylsodium siliconate functions to stabilize aqueous silicates and inhibit metal corrosion. A preferred phosphonate-functional alkylsodium siliconate is sodium trihydroxysilylpropylmethylphosphonate, which may be obtained from Dow Corning as Q1-6083.

The cleaning composition may also include about 1 to 20 parts by weight, preferably about 1 to 15 parts by weight, of one or more glycol ethers in order to boost cleaning performance on oils. Examples of the glycol ethers include propylene glycol monobutyl ether (sold as Glycol ether PNB), dipropylene glycol monomethyl ether (sold as Glycol ether DPM) and dipropylene glycol monobutyl ether (sold as Glycol ether DPNB), all available under the ARCOSOLV tradename from Lyondell via Ashland Distribution Co.& Ashland Specialty Chemical Co., Columbus, Ohio. Glycol ethers are widely accepted in electronics industry in cleaning compounds; the addition of glycol ethers to cleaning composition for such applications may provide additional solvency for soil removal without compromising the integrity of the electronic equipment.

Additional materials that may be utilized in the cleaning compositions of the present invention include defoamers, builders, such as sodium pyrophosphate, sodium hexametaphosphate, tetrasodium pyrophosphate, tetrapotassium pyrophosphate (TKPP), trisodium phosphate, sodium tripolyphosphate (STPP) and alkali metal carbonates (sodium carbonate), sequestering agents, such as EDTA, other solvent-type compounds or compositions such as ethyl hexyl lactate, anionic surfactants such as α-olefin sulfonates, nonionic surfactants such as fatty amine oxides, and phosphate esters and phosphate ester salts. A defoamer or anti-foam agent is an agent that tends to keep the cleaning product from forming an amount of foam that would interfere with the ability of a person to see the cleaning action of the composition on a metal surface; tends to increase the capability of the cleaning product to be removed from a surface by rinsing; or tends to decrease the potential for the foam to interfere with the functioning of the cleaning equipment. The defoamer should be compatible with the rest of the formula. In some cases, the silica component of a silicone defoamer may tend to be precipitated out and a non-silicone anti-foam should be used. As an example of embodiments wherein the composition have additional components, for applications where additional ingredients are desired to elevate the product pH and build its performance on grease and particulate based soils, alkaline compounds, such as sodium hydroxide and sodium metasilicate, may be used to elevate pH and build product alkalinity for cleaning, and EDTA may be incorporated as a sequestering agent for minerals and particulates. Other additives may be incorporated to raise the cloud point, for heat stability, and/or to assist in maintaining its long-term stability at the 1:10 dilution in water.

Water is included in the cleaning compositions in an amount ranging from about 20 to 1000 parts by weight. For a ready-to-use (RTU) application, all of the water is added during the manufacturing process. Where the composition is intended to be diluted by the user before use at their site, part of the water may be added by the manufacturer, typically about 20 to 75 parts by weight, preferably 30 to 70 parts by weight, with the rest added by the end user.

A cleaning composition that conforms to MIL-PRF-87937D includes:

10 to 25 parts by weight of at least one C9-C11 ethoxylated alcohol having an HLB ranging from about 10 to about 14

1 to 25 parts by weight of at least one alkanolamide 1 to 10 parts by weight of at least one C8-C10 ethoxylated alcohol having an HLB ranging from about 10 to about 14

1 to 10 parts by weight of methyl oleate 1 to 10 parts by weight of at least one alkyl polyglycoside having an HLB ranging from about 10 to about 14

0.1 to 1 parts by weight of an alkali metal silicate 0.01 to 1 parts by weight of an alkali metal hydroxide 0.01 to 1 parts by weight of a phosphonate-functional alkyl sodium siliconate 0.05 to 1 parts by weight of a phosphate ester 0.1 to 2 parts by weight of at least one modified carboxylic acid derivative corrosion inhibitor in an amount effective to prevent corrosion on aluminum, magnesium, titanium, and steel; and 30 to 1000 parts water.

The composition may also include 0.1 to 1 parts by weight of hexahydro-1,3,5-tris(2-hydroxyethyl)-s-triazine as a preservative.

In another aspect, the present invention relates to method for cleaning exterior surfaces of aircraft. The method includes providing a cleaning composition according to the present invention, applying the cleaning composition to the exterior surfaces of the aircraft, scrubbing the surfaces and rinsing the surfaces with water. If desired, the composition may be diluted before application. For MIL-PRF-87937D, the composition is diluted 1:10 with water before use.

The compositions are true cleaning microemulsions that are optically clear at multiple dilutions. Furthermore, the preferred embodiment of the present invention has a cleaning efficiency at or above 90% of the control test formula. Cleaning efficiency is determined as follows: An aluminum plate is soiled with approximately 100.0 mg of grease/carbon black blend. It is baked for 1 hr. at about 105° C., and then cooled to room temperature. Approximately 100 ml. of 10% cleaning solution is poured over the greased plate and allowed a 30-second dwell time. Then, the plate is "cleaned" on a Gardner Abrasion Device, which utilizes a sponge pre-wet with 10% cleaning solution passing 5 swipes across the soiled plate. The plate is then rinsed, dried for 10 minutes at 105° C., and weighed. The percentage of soil removed is the cleaning efficiency.

The properties of the cleaning compositions of the present invention further include a pH less than 10, biodegradable ingredients, non-corrosive to surface-treated magnesium, surface-treated aluminum, bare T3 aluminum alloy, bare T6 aluminum alloy, titanium, steel and silver-plated steel, and emulsion characteristics as specified in MIL-PRF-87937D. The cleaning composition may also possess long-term heat stability and controlled foaming. Additionally, in a preferred embodiment, the composition is comprised of approximately 29% (+/−3%) biobased content, where biobased content is defined as the amount of biobased material as fraction weight or percent weight of the total material and biobased material is defined as organic material in which carbon is derived from a renewable resource via biological processes. Biobased materials include all plant and animal mass derived from $CO_2$ recently fixed via photosynthesis, per the definition of a renewable resource.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

EXAMPLES

TABLE 1

Cleaning Formulas that Exceeded 90% Cleaning Performance

| Ingredient | Source | % |
|---|---|---|
| **Formula 1** | | |
| methyl oleate | (1) | 8.0 |
| d-limonene | (17) | 0.5 |
| pine terpenes | (18) | 0.5 |
| C12-C16 ethoxylated fatty alcohol | (23) | 16.0 |
| C8-C10 ethoxylated alcohol | (22) | 6.4 |
| alkyl polyglycoside | (24) | 9.6 |
| Chemfac NB | (2) | 0.6 |
| lauryl dimethylamine oxide | (8) | 15.0 |
| Alpha olefin sulfonate | (19) | 6.8 |
| deionized water | | 34.1 |
| tetrapotassium pyrophosphate dry | (10) | 0.8 |
| silicone antifoam | (20) | 0.7 |
| KPR370M corrosion inhibitor | (16) | 1.00 |
| **Formula 2** | | |
| methyl oleate | (1) | 8.0 |
| C12-C16 ethoxylated fatty alcohol | (23) | 16.0 |
| C8-C10 ethoxylated alcohol | (22) | 6.4 |
| alkyl polyglycoside | (24) | 9.6 |
| Chemfac NB | (2) | 0.6 |
| ethylhexyl lactate | (15) | 5.0 |
| lauryl dimethylamine oxide | (8) | 15.0 |
| deionized water | | 30.9 |
| tetrapotassium pyrophosphate | (10) | 0.8 |
| Surcide P | (6) | 0.20 |
| KPR370M corrosion inhibitor | (16) | 1.0 |
| sodium xylene sulfonate | (11) | 5.8 |
| Ecco DO-5 defoamer | (7) | 0.7 |
| **Formula 3** | | |
| methyl oleate | 1 | 9.0 |
| C12-C16 ethoxylated fatty alcohol | 23 | 18.0 |
| C8-C10 ethoxylated alcohol | 22 | 7.2 |
| alkyl polyglycoside | 24 | 10.8 |
| Chemfac NB | 2 | 1.0 |
| Cocamide DEA | 13 | 5.0 |
| Alfonic 610-3.5 | 9 | 0.9 |
| deionized water | | 43.95-44.45 |
| tetrapotassium pyrophosphate | 10 | 0.5 |
| Surcide P | 6 | 0.2 |
| sodium hydroxide | 12 | 0.15 |
| sodium xylene sulfonate | 11 | 2.0 |
| Ecco DO-5 defoamer | 7 | 0.8 |
| citric acid (to lower pH) | 14 | 0-0.5 |
| **Formula 4** | | |
| methyl oleate | 1 | 8.5 |
| C12-C16 ethoxylated fatty alcohol | 23 | 17.0 |
| C8-C10 ethoxylated alcohol | 22 | 6.8 |
| alkyl polyglycoside | 24 | 10.2 |
| Chemfac NB | 2 | 0.8 |
| lauryl dimethylamine oxide | 8 | 15.0 |
| Alfonic 610-3.5 | 9 | 0.9 |
| deionized water | | 36.3 |
| tetrapotassium pyrophosphate | 10 | 0.4 |
| Surcide P | 6 | 0.2 |
| sodium hydroxide | 12 | 0.1 |
| sodium xylene sulfonate | 11 | 3.0 |
| Ecco DO-5 defoamer | 7 | 0.8 |
| **Formula 5** | | |
| methyl oleate | 1 | 8.0 |
| C12-C16 ethoxylated fatty alcohol | 23 | 16.0 |
| C8-C10 ethoxylated alcohol | 22 | 6.4 |
| alkyl polyglycoside | 24 | 9.6 |
| Chemfac NB | 2 | 0.6 |

TABLE 1-continued

Cleaning Formulas that Exceeded 90% Cleaning Performance

| Ingredient | Source | % |
|---|---|---|
| Monamid 150-CW | 4 | 14.0 |
| Alfonic 610-3.5 | 9 | 0.9 |
| deionized water | | 43.05 |
| sodium disilicate | 5 | 0.15 |
| Surcide P | 6 | 0.2 |
| DeCore APCI-95 | 3 | 0.5 |
| Ecco DO-5 defoamer | 7 | 0.6 |
| **Formula 6** | | |
| methyl oleate | 1 | 8.0 |
| C12-C16 ethoxylated fatty alcohol | 23 | 16.0 |
| C8-C10 ethoxylated alcohol | 22 | 6.4 |
| GLUCOPON 220 UP | 24 | 9.6 |
| Chemfac NB | 2 | 0.6 |
| Monamid 150-CW | 4 | 14.0 |
| Alfonic 610-3.5 | 9 | 0.9 |
| deionized water | — | 43.05 |
| sodium disilicate | 5 | 0.15 |
| Surcide P | 6 | 0.2 |
| DeCore APCI-95 | 3 | 0.5 |
| DeCore APCI-95 | 7 | 0.6 |
| **Formula 7** | | |
| Surcide P | 6 | 0.2 |
| C9-C11 Ethoxylated Alcohols | 25 | 13.5 |
| C8-C10 Ethoxylated alcohol | 22 | 5.5 |
| alkyl polyglycoside | 21 | 8.2 |
| methyl oleate | 1 | 4.0 |
| Monamid 150-CW | 4 | 12.0 |
| DeTrope CA-100 | 26 | 0.6 |
| DeCore IMT-100LF | 27 | 0.6 |
| Triethanolamine | 28 | 0.5 |
| Sodium silicate liquid | 29 | 0.2 |
| Deionized water | — | 54.9 |
| **Formula 8** | | |
| Surcide P | 6 | 0.2 |
| C9-C11 Ethoxylated Alcohol | 25 | 12.0 |
| C8-C10 Ethoxylated alcohol | 22 | 4.0 |
| alkyl polyglycoside | 21 | 7.0 |
| methyl oleate | 1 | 3.0 |
| Monamid 150-CW | 4 | 11.5 |
| DeTrope CA-100 | 26 | 0.3 |
| DeCore IMT-100LF | 27 | 0.6 |
| sodium silicate liquid | 29 | 0.2 |
| DePhos 8028 | 30 | 0.3 |
| sodium hydroxide | 12 | 0.05 |
| deionized water | — | 60.82 |
| Q1-6083 Additive | 31 | 0.03 |
| **Formula 9** | | |
| Surcide P | 6 | 0.08 |
| C9-C11 Ethoxylated Alcohols | 25 | 10.0 |
| C8-C10 Ethoxylated Alcohols | 22 | 3.3 |
| alkyl polyglycoside | 21 | 5.8 |
| methyl oleate | 1 | 2.5 |
| Monamid 150-CW | 4 | 9.5 |
| DeTrope CA-100 | 26 | 0.25 |
| DeCore IMT-100LF | 27 | 0.5 |
| sodium silicate liquid | 29 | 0.17 |
| DePhos 8028 | 30 | 0.25 |
| sodium hydroxide | 12 | 0.04 |
| deionized water | — | 50.0-60.0 |
| Q1-6083 Additive | 31 | 0.025 |
| Glycol ether PNB | 34 | 10.0-20.0 |
| **Formula 10** | | |
| Surcide P | 6 | 0.08 |
| C9-C11 Ethoxylated Alcohol | 25 | 10.0 |
| C8-C10 Ethoxylated alcohol | 22 | 3.3 |
| alkyl polyglycoside | 21 | 5.8 |
| methyl oleate | 1 | 2.5 |
| Monamid 150-CW | 4 | 9.5 |
| DeTrope CA-100 | 26 | 0.25 |
| DeCore IMT-100LF | 27 | 0.5 |

TABLE 1-continued

Cleaning Formulas that Exceeded 90% Cleaning Performance

| Ingredient | Source | % |
|---|---|---|
| sodium silicate liquid | 29 | 0.17 |
| DePhos 8028 | 30 | 0.25 |
| sodium hydroxide | 12 | 0.04 |
| deionized water | — | 50.0-60.0 |
| Q1-6083 Additive | 31 | 0.025 |
| Glycol ether DPM | 35 | 10.0-20.0 |
| Formula 11 | | |
| Surcide P | 6 | 0.08 |
| C9-C11 Ethoxylated Alcohol | 25 | 10.0 |
| C8-C10 Ethoxylated alcohol | 22 | 3.3 |
| alkyl polyglycoside | 21 | 5.8 |
| methyl oleate | 1 | 2.5 |
| Monamid 150-CW | 4 | 9.5 |
| DeTrope CA-100 | 26 | 0.25 |
| DeCore IMT-100LF | 27 | 0.5 |
| sodium silicate liquid | 29 | 0.17 |
| DePhos 8028 | 30 | 0.25 |
| sodium hydroxide | 12 | 0.04 |
| deionized water | — | 50.0-60.0 |
| Q1-6083 Additive | 31 | 0.025 |
| Glycol ether DPNB | 36 | 10.0-20.0 |
| Formula 12 | | |
| Surcide P | 6 | 0.2 |
| C9-C11 Ethoxylated Alcohol | 25 | 12.0 |
| C8-C10 Ethoxylated alcohol | 22 | 4.0 |
| alkyl polyglycoside | 21 | 7.0 |
| methyl oleate | 1 | 3.0 |
| Monamid 150-CW | 4 | 11.5 |
| DeTrope CA-100 | 26 | 0.3 |
| DeCore IMT-100LF | 27 | 0.6 |
| sodium silicate liquid | 29 | 0.2 |
| DePhos 8028 | 30 | 0.3 |
| sodium hydroxide | 12 | 0.50 |
| deionized water | — | 60.37 |
| Q1-6083 Additive | 31 | 0.03 |
| Formula 13 | | |
| Surcide P | 6 | 0.2 |
| C9-C11 Ethoxylated Alcohol | 25 | 12.0 |
| C8-C10 Ethoxylated alcohol | 22 | 4.0 |
| alkyl polyglycoside | 21 | 7.0 |
| methyl oleate | 1 | 3.0 |
| Monamid 150-CW | 4 | 11.5 |
| DeTrope CA-100 | 26 | 0.3 |
| DeCore IMT-100LF | 27 | 0.6 |
| sodium silicate liquid | 29 | 0.2 |
| DePhos 8028 | 30 | 0.3 |
| sodium hydroxide | 12 | 0.05 |
| deionized water | — | 60.37 |
| Q1-6083 Additive | 31 | 0.03 |
| EDTA | 33 | 0.45 |
| Formula 14 | | |
| Surcide P | 6 | 0.2 |
| C9-C11 Ethoxylated Alcohol | 25 | 12.0 |
| C8-C10 Ethoxylated alcohol | 22 | 4.0 |
| alkyl polyglycoside | 21 | 7.0 |
| methyl oleate | 1 | 3.0 |
| Monamid 150-CW | 4 | 11.5 |
| DeTrope CA-100 | 26 | 0.3 |
| DeCore IMT-100LF | 27 | 0.6 |
| sodium silicate liquid | 29 | 0.2 |
| DePhos 8028 | 30 | 0.3 |
| sodium hydroxide | 12 | 0.05 |
| deionized water | — | 60.37 |
| Q1-6083 Additive | 31 | 0.03 |
| Sodium metasilicate | 32 | 0.45 |
| Formula 15 | | |
| Surcide P | 6 | 0.02 |
| C9-C11 Ethoxylated Alcohol | 25 | 1.20 |
| C8-C10 Ethoxylated alcohol | 22 | 0.4 |
| alkyl polyglycoside | 21 | 0.7 |

TABLE 1-continued

Cleaning Formulas that Exceeded 90% Cleaning Performance

| Ingredient | Source | % |
|---|---|---|
| methyl oleate | 1 | 0.3 |
| Monamid 150-CW | 4 | 1.15 |
| DeTrope CA-100 | 26 | 0.03 |
| DeCore IMT-100LF | 27 | 0.06 |
| sodium silicate liquid | 29 | 0.02 |
| DePhos 8028 | 30 | 0.03 |
| sodium hydroxide | 12 | 0.245 |
| deionized water | — | 91.045 |
| Sodium metasilicate | 31 | 0.50 |
| EDTA | 33 | 0.80 |
| Glycol ether PNB | 34 | 3.50 |
| Formula 16 | | |
| Surcide P | 6 | 0.02 |
| C9-C11 Ethoxylated Alcohol | 25 | 1.20 |
| C8-C10 Ethoxylated alcohol | 22 | 0.4 |
| alkyl polyglycoside | 21 | 0.7 |
| methyl oleate | 1 | 0.3 |
| Monamid 150-CW | 4 | 1.15 |
| DeTrope CA-100 | 26 | 0.03 |
| DeCore IMT-100LF | 27 | 0.06 |
| sodium silicate liquid | 29 | 0.02 |
| DePhos 8028 | 30 | 0.03 |
| sodium hydroxide | 12 | 0.245 |
| deionized water | — | 91.045 |
| Sodium metasilicate | 31 | 0.50 |
| EDTA | 33 | 0.80 |
| Glycol ether DPM | 35 | 3.50 |
| Formula 17 | | |
| Surcide P | 6 | 0.02 |
| C9-C11 Ethoxylated Alcohol | 25 | 1.20 |
| C8-C10 Ethoxylated alcohol | 22 | 0.4 |
| alkyl polyglycoside | 21 | 0.7 |
| methyl oleate | 1 | 0.3 |
| Monamid 150-CW | 4 | 1.15 |
| DeTrope CA-100 | 26 | 0.03 |
| DeCore IMT-100LF | 27 | 0.06 |
| sodium silicate liquid | 29 | 0.02 |
| DePhos 8028 | 30 | 0.03 |
| sodium hydroxide | 12 | 0.245 |
| deionized water | — | 91.045 |
| Sodium metasilicate | 31 | 0.50 |
| EDTA | 33 | 0.80 |
| Glycol ether DPNB | 34 | 3.50 |
| Formula 18 | | |
| Surcide P | 6 | 0.2 |
| C9-C11 Ethoxylated Alcohol | 25 | 13.0 |
| C8-C10 Ethoxylated alcohol | 22 | 8.0 |
| alkyl polyglycoside | 38 | 3.5 |
| methyl oleate | 1 | 2.5 |
| Colamid HPC | 4 | 6.0 |
| DeTrope CA-100 | 26 | 0.3 |
| DeCore IMT-100LF | 27 | 0.6 |
| sodium silicate liquid | 29 | 0.2 |
| DePhos HP 739 | 30 | 0.1 |
| sodium hydroxide | 12 | 0.05 |
| deionized water | — | 65.30 |
| Q1-6083 Additive | 31 | 0.05 |
| Sodium bicarbonate | 37 | 0.10 |
| Triethanolaine | 28 | 0.10 |

Example 1

Process #1—Formula 5

This is a two-part process for manufacturing a cleaning composition such as an aircraft cleaner. At room temperature (~68° F./20° C.), a surfactant mixture (Part A) and an aqueous/water soluble component mixture (Part B) were prepared with constant stirring in separate vessels. The Part A surfactant mixture consisted of Methyl oleate in a 1:4 ratio with a first surfactant blend comprising approximately 50% C12-C16 Ethoxylated fatty alcohols, approximately 20% C8-C10 Ethoxylated alcohols and approximately 30% Alkylpolyglucoside by weight. After these ingredients were blended to form a clear solution, Chemfac NB-041T/90 Neutralized phosphate ester was added. Then, Alfonic 610-3.5 Ethoxylated alcohol was blended into the first surfactant mixture. This was followed by the addition of Monamid 150-CW Capramide diethanolamide. Finally, DeCore APCI-95 Carboxylic acid derivative was added to the Part A component mixture. After all of the Part A ingredients were added, the mixture was stirred for approximately 10 minutes.

Part B was prepared by adding Deionized water to a clean mixing vessel. Next, Sodium disilicate was added and the mixture was stirred until clear. Surcide P Hexahydro-1,3,5-tris(2-hydroxyethyl)-s-triazine preservative was then added, followed by Ecco DO-5 Alkyl ether sulfate defoamer solution. This mixture was stirred for five minutes.

When each Part had been mixed for the appropriate time to ensure a homogenous mixture, Part B solution was added to the Part A vessel and stirred for ten minutes. The product was then ready for quality testing and packaging.

Example 2

Process #2—Formula 4

This is a two-part process for manufacturing a cleaning composition, e.g., an aircraft cleaner. At room temperature (~68° F./20° C.), a surfactant mixture (Part A) and an aqueous/water soluble component mixture (Part B) were prepared with constant stirring in separate vessels. The Part A surfactant mixture consisted of methyl oleate in a 1:4 ratio with three surfactants that were blended at an internal ratio of 50% C12-C16 Ethoxylated fatty alcohols, 20% C8-C10 Ethoxylated alcohols and 30% Alkylpolyglucoside by weight. After these ingredients were blended to form a clear solution, Chemfac NB-041T/90 Neutralized phosphate ester was added. Then, Lauryl dimethylamine oxide was blended into the first surfactant mixture. This was followed by the addition of Alfonic 610-3.5 Ethoxylated alcohol. After all of the Part A ingredients were added, the mixture was stirred for approximately 10 minutes.

Part B was prepared by adding Deionized water to a clean mixing vessel. Next, Tetrapotassium pyrophosphate was added and the mixture was stirred until clear. Sodium hydroxide was then added and stirred until the mixture was clear. Surcide P Hexahydro-1,3,5-tris(2-hydroxyethyl)-s-triazine preservative was then added, followed by Ecco DO-5 Alkyl ether sulfate defoamer solution. Finally, Lauryl dimethylamine oxide was added to the aqueous mixture, and the mixture was stirred for five minutes.

When each Part had been mixed for the appropriate time to ensure a homogenous mixture, Part B solution was added to the Part A vessel. Sodium xylene sulfonate was then added, and this mixture was stirred for ten minutes. The product was then ready for quality testing and packaging.

Example 3

Process #3—Formula 3

This is a two-part process for manufacturing a cleaning composition, e.g., an aircraft cleaner. At room temperature (~68° F./20° C.), a surfactant mixture (Part A) and an aqueous/water soluble component mixture (Part B) were prepared with constant stirring in separate vessels. The Part A surfactant mixture consisted of Methyl oleate in a 1:4 ratio with a first surfactant blend comprising approximately 50% C12-C16 Ethoxylated fatty alcohols, approximately 20% C8-C10 Ethoxylated alcohols and approximately 30% Alkylpolyglucoside by weight. After these ingredients were blended to form a clear solution, Chemfac NB-041T/90 Neutralized phosphate ester was added. Then, Cocamide diethanolamine was blended into the first surfactant mixture. This was followed by the addition of Lauryl dimethylamine oxide. Finally, Alfonic 610-3.5 Ethoxylated alcohol was added to the Part A component mixture. After all of the Part A ingredients were added, the mixture was stirred for approximately 10 minutes.

Part B was prepared by adding Deionized water to a clean mixing vessel. Next, Tetrapotassium pyrophosphate was added and the mixture was stirred until clear. Sodium hydroxide was then added and stirred until the mixture was clear. Surcide P Hexahydro-1,3,5-tris(2-hydroxyethyl)-s-triazine preservative was then added, followed by Ecco DO-5 Alkyl ether sulfate defoamer solution. This mixture was stirred for five minutes.

When each Part had been mixed for the appropriate time to ensure a homogenous mixture, Part B solution was added to the Part A vessel. Sodium xylene sulfonate was then added, followed by Citric acid, and the mixture was stirred for ten minutes. The product was then ready for quality testing and packaging.

Example 4

Process #4—Formula 2

This is a two-part process for manufacturing a cleaning composition, e.g., an aircraft cleaner. At room temperature (~68° F./20° C.), a surfactant mixture (Part A) and an aqueous/water soluble component mixture (Part B) were prepared with constant stirring in separate vessels. The Part A surfactant mixture consisted of Methyl oleate in a 1:4 ratio with a first surfactant blend comprising approximately 50% C12-C16 Ethoxylated fatty alcohols, approximately 20% C8-C10 Ethoxylated alcohols and approximately 30% Alkylpolyglucoside by weight. After these ingredients were blended to form a clear solution, Chemfac NB-041T/90 Neutralized phosphate ester was added. Then, Ethyl hexyl lactate was blended into the Part A mixture. This was followed by the addition of Lauryl dimethylamine oxide. The Part A ingredients were then stirred for approximately 10 minutes.

Part B was prepared by adding Deionized water to a clean mixing vessel. Next, Tetrapotassium pyrophosphate was added and the mixture was stirred until clear. Surcide P Hexahydro-1,3,5-tris(2-hydroxyethyl)-s-triazine preservative was then added, followed by Lauryl dimethylamine oxide, and the mixture was stirred for five minutes.

When each Part had been mixed for the appropriate time to ensure a homogenous mixture, Part B solution was added to the Part A vessel. This was followed by the addition of KPR370 M corrosion inhibitor. Then, Sodium xylene sulfonate was added to the Part A vessel. Finally, Ecco DO-5 Defoamer was added, and the mixture was stirred for ten minutes. The product was then ready for quality testing and packaging.

Example 5

Process #5—Formula 1

This is a two-part process for manufacturing a cleaning composition, e.g., an aircraft cleaner. At room temperature (~68° F./20° C.), a surfactant mixture (Part A) and an aqueous/water soluble component mixture (Part B) were prepared with constant stirring in separate vessels. The Part A surfactant mixture consisted of Methyl oleate in a 1:4 ratio with a first surfactant blend comprising approximately 50% C12-C16 Ethoxylated fatty alcohols, approximately 20% C8-C10 Ethoxylated alcohols and approximately 30% Alkylpolyglucoside by weight. After these ingredients and the d-limonene and pine terpenes were blended in the order listed above to form a clear solution, Chemfac NB-041T/90 Neutralized phosphate ester was added. Then, Lauryl dimethylamine oxide was blended into the first surfactant mixture followed by Alpha olefin sulfonate. After all of the Part A ingredients were added, the mixture was stirred for approximately 10 minutes.

Part B was prepared by adding Deionized water to a clean mixing vessel. Next, Tetrapotassium pyrophosphate was added and the mixture was stirred until clear. This was followed by the addition of Lauryl dimethylamine oxide. Then, Alpha olefin sulfonate was added to the Part B mixture and stirred for five minutes.

When each Part had been mixed for the appropriate time to ensure a homogenous mixture, Part B solution was added to the Part A vessel. Then, Silicone antifoam was added. This was followed by the addition of KPR370M corrosion inhibitor, and the mixture was stirred for ten minutes. The product was then ready for quality testing and packaging.

Example 6

Process #6—Formula 6

This is a two-part process for manufacturing a process. At room temperature (~68° F./20° C.), a surfactant mixture (Part A) and an aqueous/water soluble component mixture (Part B) were prepared with constant stirring in separate vessels. The Part A surfactant mixture consisted of methyl oleate in a 1:4 ratio with a first surfactant blend comprising approximately 50% C12-C16 Ethoxylated fatty alcohols, approximately 20% C8-C10 Ethoxylated alcohols and approximately 30% Glucopon 220 Alkylpolyglycoside by weight. After these ingredients were blended to form a clear solution, Chemfac NB-041T/90 Neutralized phosphate ester was added. Then, Alfonic 610-3.5 Ethoxylated alcohol was blended into the first surfactant mixture. This was followed by the addition of Monamid 150-CW Capramide diethanolamine. Finally, DeCore APCI-95 Carboxylic acid derivative was added to the Part A component mixture. After all of the Part A ingredients were added, the mixture was stirred for approximately 10 minutes.

Part B was prepared by adding Deionized water to a clean mixing vessel. Next, Sodium disilicate was added and the mixture was stirred until clear. Surcide P Hexahydro-1,3,5-tris(2-hydroxyethyl)-s-triazine preservative was then added, followed by Ecco DO-5 Alkyl ether sulfate defoamer solution. This mixture was stirred for five minutes.

When each Part had been mixed for the appropriate time to ensure a homogenous mixture, Part B solution was added to the Part A vessel and stirred for ten minutes. The product was then ready for quality testing and packaging.

Example 7

Process #7—Formula 5

This is a one-part process for manufacturing aircraft cleaner. At room temperature (~68° F./20° C.), Deionized water is added to a clean mixing vessel. Next, Sodium disilicate is added and the mixture is stirred until clear. Surcide P Hexahydro-1,3,5-tris(2-hydroxyethyl)-s-triazine preservative is then added, followed by Ecco DO-5 Alkyl ether sulfate defoamer solution. This mixture is stirred for five minutes. Then, a surfactant blend comprising approximately 50% C12-C16 Ethoxylated fatty alcohols, approximately 20% C8-C10 Ethoxylated alcohols and approximately 30% Alkylpolyglucoside by weight is added. After these ingredients are stirred until the solution is clear, Alfonic 610-3.5 Ethoxylated alcohol is blended into the mixture. This is followed by the addition of Monamid 150-CW Capramide diethanolamine, and then the Methyl oleate is added and stirred until clear. Then, Chemfac NB-041T/90 Neutralized phosphate ester is added. Finally, DeCore APCI-95 Carboxylic acid derivative is added, and the mixture is stirred for approximately 10 minutes. The product is then ready for quality testing and packaging. minutes. The product was then ready for quality testing and packaging.

Example 8

Process #8—Formula 7

This is a one-part process for manufacturing an aircraft cleaner. At room temperature (~68° F./20° C.), Deionized water was added to a clean mixing vessel. Next, Surcide P Hexahydro-1,3,5-tris(2-hydroxyethyl)-s-triazine preservative was added followed by Alfonic 810-4.5 surfactant. This mixture was mixed until clear. Then, surfactant Alfonic 610-3.5 was added and mixed until the mixture was clear. AG 6206 alkylpolyglycoside then added and mixed until the mixture was clear. This was followed by the addition of Methyl oleate, stirring the mixture until it becomes clear. Next, Monamid 150-CW Capramide diethanolamine was added with mixing. Then, corrosion inhibitors DeTrope CA-100 and DeCore IMT-100LF are added with mixing. This was followed by the addition of Triethanolamine. The mixture was then mixed for 5 minutes. Finally, Silicate 40 CLEAR Sodium silicate liquid was added, and the mixture was stirred for approximately 10 minutes. The product was then ready for quality testing and packaging.

Example 9

Process # 9—Formula 8

This is a one-part process for manufacturing an aircraft cleaner. At room temperature (~68° F./20° C.), Deionized water was added to a clean mixing vessel. Next, Surcide P Hexahydro-1,3,5-tris(2-hydroxyethyl)-s-triazine preservative was added followed by Sodium hydroxide, Q1-6083 Additive and Silicate 40 Clear. This mixture was mixed until clear. Then, TOMADOL 91-6 surfactant and Alfonic 810-4.5 surfactant are added and mixed until the mixture was clear. AG 6206 alkyl polyglycoside was then added and mixed until the mixture was clear. This was followed by the addition of Methyl oleate, stirring the mixture until it becomes clear. Next, Monamid 150-CW Capramide diethanolamine was added with mixing. Then, corrosion inhibitors DePhos 8028, DeTrope CA-100 and DeCore IMT-100LF are added with mixing. Finally, the mixture was stirred for approximately 10 minutes. The product was then ready for quality testing and packaging.

Example 10

Process #10—Formula 9

This is a one-part process for manufacturing an aircraft cleaner. At room temperature (~68° F./20° C.), Deionized water was added to a clean mixing vessel. Next, Surcide P Hexahydro-1,3,5-tris(2-hydroxyethyl)-s-triazine preservative was added followed by Sodium hydroxide, Q1-6083 Additive and Silicate 40 Clear. This mixture was mixed until clear. Then, TOMADOL 91-6 surfactant and Alfonic 810-4.5 surfactant are added and mixed until the mixture was clear. AG 6206 alkyl polyglycoside was then added and mixed until the mixture was clear. This was followed by the addition of Methyl oleate, stirring the mixture until it becomes clear. Next, Monamid 150-CW Capramide diethanolamine was added with mixing. Then, corrosion inhibitors DePhos 8028, DeTrope CA-100 and DeCore IMT-100LF are added with mixing. Finally Glycol ether PNB was added with mixing. The mixture was stirred for approximately 10 minutes. The product was then ready for quality testing and packaging.

Example 11

Process #11—Formula 10

This is a one-part process for manufacturing an aircraft cleaner. At room temperature (~68° F./20° C.), Deionized water was added to a clean mixing vessel. Next, Surcide P Hexahydro-1,3,5-tris(2-hydroxyethyl)-s-triazine preservative was added followed by Sodium hydroxide, Q1-6083 Additive and Silicate 40 Clear. This mixture was mixed until clear. Then, TOMADOL 91-6 surfactant and Alfonic 810-4.5 surfactant are added and mixed until the mixture was clear. AG 6206 alkyl polyglycoside was then added and mixed until the mixture was clear. This was followed by the addition of Methyl oleate, stirring the mixture until it becomes clear. Next, Monamid 150-CW Capramide diethanolamine was added with mixing. Then, corrosion inhibitors DePhos 8028, DeTrope CA-100 and DeCore IMT-100LF are added with mixing. Finally Glycol ether DPM was added with mixing. The mixture was stirred for approximately 10 minutes. The product was then ready for quality testing and packaging.

Example 12

Process #12 Formula 11

This is a one-part process for manufacturing an aircraft cleaner. At room temperature (~68° F./20° C.), Deionized water was added to a clean mixing vessel. Next, Surcide P Hexahydro-1,3,5-tris(2-hydroxyethyl)-s-triazine preservative was added followed by Sodium hydroxide, Q1-6083 Additive and Silicate 40 Clear. This mixture was mixed until clear. Then, TOMADOL 91-6 surfactant and Alfonic 810-4.5 surfactant are added and mixed until the mixture was clear. AG 6206 alkyl polyglycoside was then added and mixed until the mixture was clear. This was followed by the addition of Methyl oleate, stirring the mixture until it becomes clear. Next, Monamid 150-CW Capramide diethanolamine was added with mixing. Then, corrosion inhibitors DePhos 8028, DeTrope CA-100 and DeCore IMT-100LF are added with mixing. Finally Glycol ether DPNB was added with mixing. The mixture was stirred for approximately 10 minutes. The product was then ready for quality testing and packaging.

Example 13

Process #13 Formula 12

This is a one-part process for manufacturing an aircraft cleaner. At room temperature (~68° F./20° C.), Deionized water was added to a clean mixing vessel. Next, Surcide P Hexahydro-1,3,5-tris(2-hydroxyethyl)-s-triazine preservative was added followed by Sodium hydroxide, Q1-6083 Additive and Silicate 40 Clear. This mixture was mixed until clear. Then, TOMADOL 91-6 surfactant and Alfonic 810-4.5 surfactant are added and mixed until the mixture was clear. AG 6206 alkyl polyglycoside was then added and mixed until the mixture was clear. This was followed by the addition of Methyl oleate, stirring the mixture until it becomes clear. Next, Monamid 150-CW Capramide diethanolamine was added with mixing. Then, corrosion inhibitors DePhos 8028, DeTrope CA-100 and DeCore IMT-100LF are added with mixing. Finally, the mixture was stirred for approximately 10 minutes. The product was then ready for quality testing and packaging.

Example 14

Process #14 Formula 13

This is a one-part process for manufacturing an aircraft cleaner. At room temperature (~68° F./20° C.), Deionized water was added to a clean mixing vessel. Next, Surcide P Hexahydro-1,3,5-tris(2-hydroxyethyl)-s-triazine preservative was added followed by Sodium hydroxide, EDTA, Q1-6083 Additive and Silicate 40 Clear. This mixture was mixed until clear. Then, TOMADOL 91-6 surfactant and Alfonic 810-4.5 surfactant are added and mixed until the mixture was clear. AG 6206 alkylpolyglycoside is then added and mixed until the mixture was clear. This was followed by the addition of Methyl oleate, stirring the mixture until it becomes clear. Next, Monamid 150-CW Capramide diethanolamine was added with mixing. Then, corrosion inhibitors DePhos 8028, DeTrope CA-100 and DeCore IMT-100LF are added with mixing. Finally, the mixture was stirred for approximately 10 minutes. The product was then ready for quality testing and packaging.

Example 15

Process #15 Formula 14

This is a one-part process for manufacturing an aircraft cleaner. At room temperature (~68° F./20° C.), Deionized water was added to a clean mixing vessel. Next, Surcide P Hexahydro-1,3,5-tris(2-hydroxyethyl)-s-triazine preservative was added followed by Sodium hydroxide, Sodium Metasilicate, Q1-6083 Additive and Silicate 40 Clear. This mixture was mixed until clear. Then, TOMADOL 91-6 surfactant and Alfonic 810-4.5 surfactant are added and mixed until the mixture was clear. AG 6206 alkylpolyglycoside was then added and mixed until the mixture was clear. This was followed by the addition of Methyl oleate, stirring the mixture until it becomes clear. Next, Monamid 150-CW Capramide diethanolamine was added with mixing. Then, corrosion inhibitors DePhos 8028, DeTrope CA-100 and DeCore IMT-100LF are added with mixing. Finally, the mixture was stirred for approximately 10 minutes. The product was then ready for quality testing and packaging.

Example 16

Process #16 Formula 15

This is a one-part process for manufacturing an aircraft cleaner. At room temperature (~68° F./20° C.), Deionized water was added to a clean mixing vessel. Next, Surcide P Hexahydro-1,3,5-tris(2-hydroxyethyl)-s-triazine preservative was added followed by Sodium hydroxide, Sodium Metasilicate, EDTA, Q1-6083 Additive and Silicate 40 Clear. This mixture was mixed until clear. Then, TOMADOL 91-6 surfactant and Alfonic 810-4.5 surfactant are added and mixed until the mixture was clear. AG 6206 alkylpolyglycoside was then added and mixed until the mixture was clear. This was followed by the addition of Methyl oleate, stirring the mixture until it becomes clear. Next, Monamid 150-CW Capramide diethanolamine was added with mixing. Then Glycol ether PNB was added with mixing, followed by adding corrosion inhibitors DePhos 8028, DeTrope CA-100 and DeCore IMT-100LF with mixing. Finally, the mixture was stirred for approximately 10 minutes. The product was then ready for quality testing and packaging.

Example 17

Process #17 Formula 16

This is a one-part process for manufacturing an aircraft cleaner. At room temperature (~68° F./20° C.), Deionized water was added to a clean mixing vessel. Next, Surcide P Hexahydro-1,3,5-tris(2-hydroxyethyl)-s-triazine preservative was added followed by Sodium hydroxide, Sodium Metasilicate, EDTA, Q1-6083 Additive and Silicate 40 Clear. This mixture was mixed until clear. Then, TOMADOL 91-6 surfactant and Alfonic 810-4.5 surfactant are added and mixed until the mixture was clear. AG 6206 alkylpolyglycoside was then added and mixed until the mixture was clear. This was followed by the addition of Methyl oleate, stirring the mixture until it becomes clear. Next, Monamid 150-CW Capramide diethanolamine was added with mixing. Then Glycol ether DPM was added with mixing, followed by adding corrosion inhibitors DePhos 8028, DeTrope CA-100 and DeCore IMT-100LF with mixing. Finally, the mixture was stirred for approximately 10 minutes. The product was then ready for quality testing and packaging.

Example 18

Process #18 Formula 17

This is a one-part process for manufacturing an aircraft cleaner. At room temperature (~68° F./20° C.), Deionized water was added to a clean mixing vessel. Next, Surcide P Hexahydro-1,3,5-tris(2-hydroxyethyl)-s-triazine preservative was added followed by Sodium hydroxide, Sodium Metasilicate, EDTA, Q1-6083 Additive and Silicate 40 Clear. This mixture was mixed until clear. Then, TOMADOL 91-6 surfactant and Alfonic 810-4.5 surfactant are added and mixed until the mixture was clear. AG 6206 alkylpolyglycoside was then added and mixed until the mixture was clear. This was followed by the addition of Methyl oleate, stirring the mixture until it becomes clear. Next, Monamid 150-CW Capramide diethanolamine was added with mixing. Then Glycol ether DPNB was added with mixing, followed by adding corrosion inhibitors DePhos 8028, DeTrope CA-100 and DeCore IMT-100LF with mixing. Finally, the mixture was stirred for approximately 10 minutes. The product is then ready for quality testing and packaging.

Example 19

Process # 19 Formula 18

This is a one-part process for manufacturing an aircraft cleaner. At room temperature (~68° F./20° C.), Deionized water was added to a clean mixing vessel. Next, Surcide P Hexahydro-1,3,5-tris(2-hydroxyethyl)-s-triazine preservative was added followed by DePhos HP-739, Triethanolamine, Sodium hydroxide, Sodium bicarbonate, Q1-6083 Additive and Silicate 40 Clear. This mixture was mixed until clear. Then, TOMADOL 91-6 surfactant and Alfonic 810-4.5 surfactant are added and mixed until the mixture was clear. Glucopon 225 DK alkyl polyglycoside was then added and mixed until the mixture was clear. This was followed by the addition of Methyl oleate, stirring the mixture until it becomes clear. Next, Colamid HPC Capramide diethanolamine was added with mixing. Then, corrosion inhibitors, DeTrope CA-100 and DeCore IMT-100LF are added with mixing. Finally, the mixture was stirred for approximately 10 minutes. The product was then ready for quality testing and packaging.

TABLE 2

| Aircraft Cleaner Formula Master Ingredient List |
|---|
| 1) Methyl oleate-(high purity)-(referred to as Methyl oleate)<br>trade names: Carolube 1885 from Chemol Company, Greensboro, NC 27406<br>or<br>Esterol 1336 from VICTORIAN CHEMICAL COMPANY PTY. LTD., Richmond, VIC. 3121, Australia |
| 2) Phosphate ester salt-(referred to as Chemfac NB)<br>trade name: Chemfac NB-041T/90 from Chemax Performance Products, member of RUTGERS Organics, Greenville, SC 29606 |
| 3) Carboxylic acid derivative-(referred to as DeCore APCI-95)<br>trade name: DeCore APCI-95 from DeForest Enterprises, Inc., Boca Raton, FL 33487 |
| 4) Capramide diethanolamine-(referred to as Monamid 150-CW)<br>trade name: Monamid 150-CW from Uniqema, New Castle, DE 19720<br>or<br>Capramide diethanolamine (referred to as Colamid HPC)<br>trade name: Colamid HPC from Colonial Chemicals, S. Pittsburg, TN |
| 5) Sodium disilicate-(referred to as Sodium disilicate)<br>trade name: D ® from PQ Corporation (manufacturer), Valley Forge, PA 19482<br>or<br>SOD SILICATE 50 DEG BE from Ashland Specialty Chemicals (supplier), Columbus, OH 43216 |

TABLE 2-continued

| Aircraft Cleaner Formula Master Ingredient List |
|---|
| 6) Hexahydro-1,3,5-tris(2-hydroxyethyl)-s-triazine-(referred to as Surcide P)<br>trade name: Surcide P from Surety Laboratories, Cranford, NJ 07016 |
| 7) Alkyl ether sulfate solution-(referred to as ECCO DO-5 Defoamer)<br>trade name: ECCO DEFOAMER DO-5 from Eastern Color & Chemical Company, Providence, RI 02904 |
| 8) Lauryl dimethylamine oxide-(referred to as Lauryl dimethylamine oxide)<br>trade name: SURFOX LO SPECIAL from Surfactants, Inc., South Plainfield, NJ 07080 |
| 9) Ethoxylated alcohol-(referred to as Alfonic 610-3.5)<br>trade name: ALFONIC ® 610-3.5 ETHOXYLATE from Sasol North America Inc., Houston, TX 77079 |
| 10) Tetrapotassium pyrophosphate-(referred to as Tetrapotassium pyrophosphate)<br>trade name: Tetrapotassium Pyrophosphate, Dry from FMC Corporation, Phosphorus Chemicals Division, Philadelphia, PA 19103 |
| 11) Sodium xylenesulfonate-(referred to as Sodium xylenesulfonate)<br>trade name: Stepanate SXS from Stepan Company, Northfield, IL 60093 |
| 12) Sodium hydroxide-(referred to as Sodium hydroxide)<br>trade name: CAUSTIC SODA BEADS from Ineoschlor Limited or Occidental Chemical Company via Ashland Distribution Co. & Ashland Specialty Chemical Co., Columbus, OH 43216 |
| 13) Cocamide diethanolamine-(referred to as Cocamide DEA)<br>trade name: Calamide C from Pilot Chemical Company, Santa Fe Springs, CA 90640 |
| 14) Citric acid-(referred to as Citric acid)<br>trade name: CITRIC ACID ANHYD USP QKR BENG from Archer Daniels Midland via Ashland Distribution Co. & Ashland Specialty Chemical Co., Columbus, OH 43216 |
| 15) Ethylhexyl lactate-(referred to as Ethylhexyl lactate)<br>trade name: PURASOLV ® EHL from PURAC America, Inc., Lincolnshire, IL 60069 |
| 16) Proprietary corrosion inhibitor-(referred to as KPR370M Corrosion inhibitor)<br>trade name: KPR370M from KPR ADCOR INC., Niagara Falls, NY 14301 |
| 17) d-Limonene-(referred to as d-Limonene)<br>trade name: d-limonene or Orange terpenes from Pine Derivatives or PDM, Inc., Wilmington, DE 19810 |
| 18) Pine terpenes-(referred to as Pine terpenes)<br>trade name: Unipine 85 from Bush Boake Allen Inc., Jacksonville, FL 32254 |
| 19) Alpha olefin sulfonate-(referred to as Alpha olefin sulfonate)<br>trade name: BIO-TERGE AS-40 from Stepan Company, Northfield, IL 60093<br>or<br>Calsoft AOS-40 from Pilot Chemical Company, Santa Fe Springs, CA 90640 |
| 20) Silicone antifoam-(referred to as Silicone antifoam)<br>trade name: Antifoam 1430 from Dow Corning Corporation, Midland, MI 48686 |
| 21) Alkyl polyglycoside-(referred to as Alkyl polyglycoside)<br>trade name: AG 6206 from Akzo Nobel Surface Chemistry LLC, Chicago, IL 60606 |
| 22) C8-C10 Ethoxylated alcohols-(referred to as C8-C10 Ethoxylated alcohols)<br>trade name: ALFONIC ® 810-4.5 ETHOXYLATE from CONDEA VISTA Company, Houston, TX 77079 |
| 23) C12-C16 Ethoxylated fatty alcohols-(referred to as C12-C16 Ethoxylated fatty alcohols)<br>trade name: GENAPOL 26 L 60 from Clariant Corporation, Charlotte, NC 28205 |
| 24) Alkyl polyglycoside-(Referred to as Glucopon 220)<br>trade name: GLUCOPON 220 UP from Cognis Corporation, Cincinnati, OH 45232 |
| 25) C9-C11 Ethoxylated alcohols-(referred to as C9-C11 Ethoxylated alcohols)<br>trade name: TOMADOL 91-6 from Tomah Reserve, Inc., Reserve LA 70084 |
| 26) Carboxylic acid derivative-(referred to as DeTrope CA-100)<br>trade name: DeTrope Ca-100 from DeForest Enterprises, Inc., Boca Raton, FL |
| 27) Carboxylic acid derivative-(referred to as DeCore IMT100-LF)<br>trade name: DeCore IMT100-LF from DeForest Enterprises, Inc., Boca Raton, FL |
| 28) Triethanolamine-(referred to as Triethanolamine)<br>trade name: TRIETHANOLAMINE 85% LOW FRZ GD - from Ashland, Columbus, OH |
| 29) Sodium disilicate-(referred to as Sodium silicate liquid)<br>trade name: 40 CLEAR from Occidental Chemical Corp., Dallas, Texas |
| 30) Phosphate ester-(referred to as DePhos HP 739)<br>trade name: DePhos Hp 739 from DeForest Enterprises, Inc., Boca Raton, FL |
| 31) Organofunctional siloxane (referred to as Q1-6083 Additive)<br>trade name: Q1-6083 ANTIFREEZE ADDITIVE from Dow Corning Corp., Midland, MI |
| 32) Sodium metasilicate pentahydrate-(referred to as Sodium Metasilicate)<br>trade name: Metso Pentabead 20 from PQ Corporation, Valley Forge, PA |
| 33) Tetrasodium EDTA-(referred to as EDTA)<br>trade name: Dissolvine E-39 from Akzo Nobel Functional Chemicals LLC, 1747 Lima, OH 45804- |

TABLE 2-continued

| Aircraft Cleaner Formula Master Ingredient List |
|---|
| 34) Propylene glycol monobutyl ether-(referred to as Glycol ether PNB)<br>trade name: Arcosolve PNB from Lyondell via Ashland Distribution Co.& Ashland Specialty Chemical Co., Columbus, OH 43216 |
| 35) Dipropylene glycol monomethyl ether-(referred to as Glycol ether DPM)<br>trade name: Arcosolv DPM from Arco via Ashland Chemical Co., Columbus, OH 43216 |
| 36) Dipropylene glycol monobutyl ether-(referred to as Glycol ether DPNB)<br>trade name: Arcosolv DPNB from Lyondell via Ashland Distribution Co.& Ashland Specialty Chemical Co., Columbus, OH 43216 |
| 37) Sodium bicarbonate-(referred to as Sodium bicarbonate)<br>trade name: Sodium Bicarbonate from FMC Corporation, Philadelphia, PA |
| 38) Alkyl polyglycoside-(referred to as alkyl polyglycoside<br>trade name: Glucopon 225 DK from Cognis Chemicals, Cincinnati, OH 45232 |

Table 3 is a comparison of properties of the aircraft cleaning compositions of Examples 1-8 & 19.

TABLE 3

Comparison of Properties of Aircraft Cleaners

| | Process #1 | Process #2 | Process #3 | Process #4 | Process #5 | Process #6 | Process #7 | Process #8 | Process #19 |
|---|---|---|---|---|---|---|---|---|---|
| Cloud Point of Concentrate | >200° F. | >200° F. | >200° F. | >200° F. | >180° F. | >180° F. | >180° F. | >180° F. | >180° F. |
| Cloud Point of Dilute* | ~180° F. | ~170° F. | ~120° F. | ~150° F. | ~130° F. | ~150° F. | ~130° F. | ~139° F. | ~130° F. |
| pH of Concentrate | ~8.1 | ~8.4 | ~9.5 | ~9.0 | ~9.6 | ~9.5 | ~9.5 | ~9.7 | ~9.5 |
| pH of Dilute* | ~8.1 | ~8.3 | ~9.4 | ~8.8 | ~9.4 | ~9.2 | ~9.4 | ~9.7 | ~9.1 |
| Color of Concentrate | Clear Amber | Clear Amber | Clear Amber | Clear Amber | Clear Amber | Ligtht Straw | Clear Amber | Clear Amber | Clear Amber |
| Color of Dilute* | Light Yellow | Slight Yellow | Slight Yellow | Slight Yellow | Slight Yellow | Colorless | Slight Yellow | Slight Yellow | Light Yellow |
| Odor | Mild terpene | Mild | Mild | Mild | Mild | Mild | Mild | Mild | Mild |

*Dilute equals the solution produced by diluting 1 part of the concentrated product with 9 parts of distilled water per military specification requirements.

TABLE 4

MIL-PRF-87937D

TABLE I Quantitative Requirements

| | TYPE I | | TYPE II | | TYPE III | | TYPE IV | | TEST |
|---|---|---|---|---|---|---|---|---|---|
| REQUIREMENT | MIN | MAX | MIN | MAX | MIN | MAX | MIN | MAX | METHOD |
| Insoluble Matter (WT %) | | 0.05 | | 0.05 | | 0.05 | | 0.05 | 4.5.2 |
| Flash Point (° F.) | | | | | | | | | |
| 10% Solution | 200 | | | | | | | | |
| Concentrated Solution | 120 | | None 1/ | | None1/ | | None1/ | | 4.5.7 |
| Emulsion Characteristics (ml free water) | | | | | | | | | |
| 5 min. | | 5.0 | | 5.0 | | 5.0 | | 5.0 | |
| 8 hours | 13.0 | | | | | | | | 4.5.8 |
| 24 hours | | | 13.0 | | 8.0 | | 11.0 | | |
| Wet Adhesion Tape Test | | | Pass | | | | 90 | | 4.5.27 |
| % Cleaning Efficiency | 95 | | 65 | | 65 | | 90 | | 4.5.21 |
| Terpene hydrocarbons (% WT) | 25 | 40 | — | None | — | None | — | None | 4.5.23 |

TABLE 4-continued

| MIL-PRF-87937D |
|---|
| 1/ No flash point should be observed up to the boiling point of the compound. |

TABLE II Total Immersion Corrosion Requirements

| Alloy | Average of 3 Panels Weight Loss, Max ($mg/cm^2$/168 hrs.) |
|---|---|
| Magnesium (AZ 31B-H24) AMS 4377 surface treatment per SAE AMS M-3171, Type III | 0.50 |
| Aluminum, SAE AMS QQ-A-250/4, T3 surface treatment per MIL-A-8625, Type I, Class I | 0.15 |
| Aluminum, SAE AMS QQ-A-250/4, Bare T3 Alloy | 0.15 |
| Aluminum, SAE AMS QQ-A-250/12, Bare T6 Alloy | 0.15 |
| Titanium, SAE AMS T-9046, 6AL-4V Class III, Composition C | 0.10 |
| Steel, AMS 5046, SAE 1020 | 0.25 |
| Steel, 410 SS, Silver Plated per SAE AMS 2410 | 0.10 |

TABLE 5

Summary of Test Results for Formula #18 (Process #19)
Performed by SMI Inc.
MIL-PRF-87937D (24 Sep 2001)
CLEANING COMPOUND, AEROSPACE EQUIPMENT
Type IV - Heavy Duty, Water Dilutable Cleaning Compound

| | | |
|---|---|---|
| 3.3 | Toxicity | Informational |
| 3.3.4 | Biodegradability | Conforms |
| 3.4 | Compositional assurance | Informational |
| 3.5 | Chemical properties | |
| 3.5.1 | Chemical requirements | |
| | Insoluble matter | Conforms |
| | Flash point | Conforms |
| | Emulsion characteristics | Conforms |
| | Wet adhesion tape test | Conforms |
| | % Cleaning efficiency | Conforms |
| | Terpene hydrocarbons | Not Applicable |
| 3.5.2 | Residue rinsibility | Conforms |
| 3.6 | Physical properties | |
| 3.6.1 | Heat stability | Conforms |
| 3.6.2 | Cold stability | Conforms |
| 3.7 | Effect on metals | |
| 3.7.1 | Hydrogen embrittlement | Conforms |
| 3.7.2 | Total immersion corrosion | Conforms |
| 3.7.3 | Low-embrittling cadmium plate corrosion | Conforms |
| 3.7.4 | Effects on unpainted metal surfaces | Conforms |
| 3.7.5 | Sandwich corrosion | Conforms |
| 3.7.6 | Wet adhesion tape test | Conforms |
| 3.8 | Effect on painted surfaces | Conforms |
| 3.9 | Stress crazing of MIL-PRF-5425 and MIL-PRF-25690 (Type A and C) acrylic plastics | Conforms |
| 3.10 | Stress crazing of polycarbonate plastics | Conforms |
| 3.11 | Long-term storage stability | In Progress (due November 2007) |
| 3.12 | Hot dip galvanizing corrosion | Conforms |
| 3.13 | Workmanship | To be Cert. by Mfr. |
| 3.14 | Effect on polysulfide sealants | Conforms |
| 3.15 | Rubber compatibility | Conforms |
| 3.16 | Effect on polyimide insulated wire | Conforms |

TABLE 6

Detailed Test Results Performed by SMI Inc.

3.3.4 Biodegradability: The supplier of the cleaning compound shall furnish certification from the surfactant manufacturers that the surfactants are readily biodegradable in accordance with 40 CFR, Part 796, Subpart D. Biodegradability testing shall be accomplished as specified in paragraph 4.5.222 on the finished product by an independent laboratory approved by the qualifying activity. Biodegradability on the finished product shall be TABLE 6-continued determined over 28 days by the Shake Flask Method monitored by analysis of Total Organic Carbon (TOC). The Type I compound shall meet the requirement of a minimum of 75% biodegradable and Types II, III, and IV compounds shall meet the requirement of a minimum of 85% biodegradable at the end of the 28-day period.

Biodegradability after 28 days = 88.8%

Result Conforms 3.5 Chemical properties.

3.5.1 Chemical requirements: The cleaning compound shall meet the requirements listed in Table I.

Table I

| Requirement | Type IV Min. | Type IV Max. | Test Method |
|---|---|---|---|
| Insoluble Matter (WT %) | — | 0.05 | 4.5.2 |
| Flash Point (° F.) | | | |
| 10% solution | None[1] | — | 4.5.7 |
| concentrate | None[1] | — | |
| Emulsion Characteristics | | | |
| (mls free water) | | | |
| 5 minutes | — | 5.0 | 4.5.8 |
| 8 hours | — | — | |
| 24 hours | 11.0 | — | |
| Wet Adhesion Tape Test | Pass | | 4.5.27 |
| % Cleaning Efficiency | 90% | — | 4.5.21 |
| Terpene Hydrocarbons (% WT) | — | None | 4.5.23 |

1/No flash point should be observed up to the boiling point of the compound.

4.5.2. Insoluble matter The percent insolubles shall be calculated as follows:

$$I = \frac{A - B}{W} \times 100$$

Where: A = Final filter paper weight
B = Initial filter paper weight
W = Weight of sample
I = % wt. insoluble matter Insoluble matter = <0.01%

Result Conforms 4.5.7 Flash point: The flash point of the concentrated cleaning compound (Type I, II, III and IV) shall be determined in accordance with ASTM D 56 (Tag Closed Cup) and for materials that have a tendency to form a surface film under the test conditions, use ASTM D 93. The flash point of the 10% solution in distilled water (Type I only) shall be determined in accordance with ASTM D 92.

TABLE 6-continued

Concentrate: No flash point observed to initial boiling point 212° F.

Result Conforms 4.5.8 Emulsion characteristics: Twenty ml of a 25% by volume solution (Types I and II) of the cleaning compound (12.5% by volume solution for Types III and IV) shall be placed in a 50 ml glass stoppered graduated cylinder. Twenty ml of lubricating oil conforming to MIL-PRF-2104, grade 10 W, shall be added. An emulsion shall be formed by 10 inversions of the graduated cylinder followed by a vigorous 15-second shake. After the emulsion has stood for 5 minutes, the 15-secound shake shall be repeated. At 5 minutes and 8 hours for the Type I and at 5 minutes and 24 hours for the Types II, III and IV cleaners, the amount of free water and cleaner which separates from the lubricating oil shall conform to the requirements of Table I.

Amount of free water remaining:

After 5 minutes <5 mls After 24 hours: 16 mls

Result Conforms 4.5.21 Cleaning Efficiency: The cleaning efficiency of the cleaning compound shall be reported as the average of three test results and shall conform to the requirements of Table I.

3.5.2 Residue Rinsibility: When a freshly prepared solution of the cleaning compound is tested in accordance with 4.5.4, it shall not leave any residue or stains. A freshly prepared solution is defined as one being prepared no longer than 30 minutes prior to testing. The weight change shall be not greater than that obtained with standard hard water tested under the same conditions.

Result Conforms 3.6 Physical properties (All types unless otherwise noted).

3.6.1 Heat stability: The concentrated cleaning compound, when tested in accordance with 4.5.5, shall show no marked color change or precipitation and shall not corrode or stain the AMS 5046 (SAE 1020) steel strip (a slight darkening of the steel strip shall not be objectionable). Layering or separation shall constitute failure if it does not return to its original homogeneous state upon cooling.

No corrosion of steel strip; no precipitation; no layering nor separation

Result Conforms 3.6.2 Cold stability: The concentrated cleaning compound shall return to its original homogeneous condition when tested in accordance with 4.5.6.

Compound returned to original homogeneous condition after exposure

Result Conforms 3.7 Effect on metals (All types unless otherwise noted).

3.7.1 Hydrogen embrittlement: When tested in accordance with 4.5.9, the concentrated cleaner (all types) and a 10% solution of the cleaner (Types I, II, and IV only) in distilled water shall not cause hydrogen embrittlement of cadmium plated or IVD aluminum coated AISI 4340 steel.

Specimens: Type 1c, cadmium plated in accordance with Treatment B of ASTM F519

As received: No failures within 150 hours.

Dilute (10%): No failures within 150 hours.

Result Conforms

Specimens: Type 1c, grit blasted, IVD Aluminum plated per MIL-DTL-83488D, C12, Ty 1.

As received: No failures within 150 hours.

Dilute (10%): No failures within 150 hours.

Result Conforms 3.7.2 Total immersion corrosion: When tested in accordance with 4.5.10 (ASTM F 483), the concentrated cleaning compound (all types) and a 10% solution of the cleaning compound (Types I, II and IV only) in distilled water shall not show any indication of staining, etching, pitting, or localized attack on any of the panels, or cause a weight change of an average of three (3) test panels greater than that shown in Table II. A slight discoloration of the panels shall not be objectionable. The cleaning compound shall not layer or separate for the duration of the test.

TABLE 6-continued

Table II Total Immersion Corrosion Requirements

| Alloy | Weight Loss ($mg/cm^2$/168 hrs) Maximum allowed | As received | Dilute (10%) |
|---|---|---|---|
| Magnesium (AZ 31B-H24) AMS 4377 surface treatment per SAE AMS-M-3171, Ty III | 0.50 | 0.01 | 0.01 |
| Aluminum, SAE AMS-QQ-A-250/4, T3 surface treatment per MIL-A-8625, Type I, Class I | 0.15 | 0.01 | 0.01 |
| Aluminum, SAE AMS-QQ-A-250/4, Bare T3 Alloy | 0.15 | 0.01 | 0.01 |
| Aluminum, SAE AMS-QQ-A-250/12, Bare T6 Alloy | 0.15 | 0.01 | 0.02 |
| Titanium, SAE AMS-T-9046, 6AI-4V CI III, Comp. C | 0.10 | 0.01 | 0.01 |
| Steel, AMS 5046, Grade 1020 | 0.25 | 0.01 | 0.01 |
| Steel, 410 SS, Silver Pleated per SAE AMS 2410 | 0.10 | 0.01 | 0.02 |

Result Conforms 3.7.3 Low-embrittling cadmium plate corrosion: Steel panels coated with low-embrittling cadmium plate immersed in the concentrated cleaning compound (all types) and a 10% solution of the cleaning compound (Types I, II and IV only) in distilled water shall not show a weight change greater than 0.14 $mg/cm^2$ for 24 hours when tested in accordance with 4.5.11.

As received: 0.04 $mg/cm^2$/24 hrs

Dilute (10%): 0.02 $mg/cm^2$/24 hrs

Result Conforms 3.7.4 Effects on unpainted metal surfaces: The concentrated cleaning compound (Type III only) and a 10% solution (Types I, II and IV only) of the cleaning compound in distilled water shall not cause streaking, stains or other deposits that cannot be easily removed with water when tested in accordance with 4.5.12.

Result Conforms 3.7.5 Sandwich corrosion: When tested in accordance with 4.5.16, the concentrated cleaner (all types) and a 10% solution (Types I, II and IV only) shall show no corrosion in excess of that shown by control test coupons in ASTMD 1193, Type IV, reagent water.

| | 2024-T3 Bare Anodized | 2024-T3 Alclad | 7075-T6 Bare Anodized | 7075-T6 Alclad |
|---|---|---|---|---|
| As received | 1 | 1 | 1 | 1 |
| Dilute (10%) | 1 | 1 | 1 | 1 |
| Control | 1 | 1 | 1 | 1 |

Result Conforms 3.7.6 Wet Adhesion tape test (Types II and IV): A ten (10) percent solution of the cleaning compound, when used as directed, shall remove soil from a painted surface in preparation for repainting such that paint applied after cleaning with the compound shall adhere to the surface when tested in accordance with 4.5.27.

| COATING SYSTEM | OBSERVATIONS |
|---|---|
| SET 1: Primer: MIL-PRF-85582, Type I, Class 1B Waterborne Epoxy Topcoat: MIL-PRF-85285 Type I High Solids Polyurethane, Color # 34092 | Coating system showed no sign of damage. |
| Set 2: Primer: MIL-PRF-23377, Type I, Class C High Solids Epoxy Topcoat: MIL-PRF-85285 Type I High Solids Polyurethane, Color # 34092 | Coating system showed no sign of damage. |
| Set 3: Primer: TT-P-2760, Type I, Class C High Solids Elastomeric, Polyurethane Topcoat: MIL-C-85285 Type I High Solids Polyurethane, Color # 34092 | Coating system showed no sign of damage. |

TABLE 6-continued

| | | Result | Conforms |
|---|---|---|---|
| 3.8 | Effect on painted surfaces: The concentrated compound (Type III only) and a 25% solution (Types I, II and IV) of the cleaning compound in distilled water shall not cause streaking, blistering, discoloration or a permanent decrease in film hardness of more than one (1) pencil hardness level when tested in accordance with 4.5.13. The Type I material shall be tested using only the (H) Polyurethane paint systems. | | |

| PANEL SET | RESULT Conc. | RESULT 25% |
|---|---|---|
| E (Epoxy topcoat)<br>Primer: MIL-PRF-23377, Ty I, Class C High-Solids Epoxy Primer<br>Topcoat: MIL-PRF-22750, Topcoat, Color #: 17925 | N/A | PASS |
| H (Polyurethane)<br>Primer: MIL-PRF-23377, Ty I, Class C High-Solids Epoxy Primer<br>Topcoat: MIL-PRF-85285 Ty I, Polyurethane, High Solids, Color # 17925 | N/A | PASS |
| F (Enamel)<br>Primer: MIL-PRF-23377, Ty I, Class C High-Solids Epoxy Primer<br>Topcoat: TT-E-529 Enamel, Semi-gloss, Color #: 27925 | N/A | PASS |

| | | Result | Conforms |
|---|---|---|---|
| 3.9 | Stress crazing of MIL-PRF-5425 and MIL-PRF-25690 (Type A and C) acrylic plastics:<br>The concentrated product (Type III only) and a 10% solution (Types I, II and IV) in distilled water shall not cause stress crazing or staining of acrylic plastics when tested in accordance with 4.5.14. | | |

| Material | As received | Dilute (10%) |
|---|---|---|
| MIL-PRF-5425 (Type A) | N/A | PASS |
| MIL-PRF-25690 (Type C) | N/A | PASS |

| | | Result | Conforms |
|---|---|---|---|
| 3.10 | Stress crazing of polycarbonate plastic: The concentrated product (Type III only) and a 10% solution (Types I, II and IV) in distilled water shall not cause stress crazing or staining of polycarbonate plastic conforming to MIL-P-83310 when tested in accordance with 4.5.15. | | |

| Material | As received | Dilute (10%) |
|---|---|---|
| MIL-P-83310 (Polycarbonate) | N/A | PASS |

| | | Result | Conforms |
|---|---|---|---|
| 3.12 | Hot dip galvanizing corrosion: The concentrated product (Type III only) and a 10% solution of the cleaning compound (Types I, II and IV) in distilled water shall not show a weight change of an average of three (3) test panels greater than 0.14 mg/cm$^2$ when tested in accordance with 4.5.18. | | |

As received: Not applicable
Dilute (10%): 0.05 mg/cm$^2$/24 hours

| | | Result | Conforms |
|---|---|---|---|
| 3.14 | Effect on polysulfide sealants: The concentrated cleaning compound (Type III only) and a 25% solution (Types I, II and IV) of the cleaning compound in distilled water shall not change the durometer hardness of the polysulfide sealant by more than 5 units when tested in accordance with 4.5.19. | | |

Dilute (25%):
Sealants: MIL-S-81733 Type 1: <5 units hardness change
MIL-S-8802 Type 1: <5 units hardness change

| | | Result | Conforms |
|---|---|---|---|
| 3.15 | Rubber compatibility: The concentrated cleaning compound (Type III only) and a 25% solution (Types I, II and IV only) of the cleaning compound in distilled water shall not change the durometer hardness more than 5 units when tested in accordance with 4.5.20. | | |

Dilute (25%):
Rubbers: AMS 3204: <5 units hardness change
AMS 3209: <5 units hardness change

| | | Result | Conforms |
|---|---|---|---|
| 3.16 | Effect on polyimide insulated wire: The cleaning compound, when tested according to 4.5.26, shall not cause dissolution, cracking, or dielectric breakdown (leakage) of the polyimide insulated wire in excess of that produced by distilled water. | | |

As received:
No dissolution or cracking of insulation.
No dielectric breakdown.

The invention claimed is:

1. A cleaning composition comprising:

at least one fatty acid methyl ester and at least one surfactant in an amount effective to create an optically clear and stable emulsion;

about 1 to about 25 parts by weight of at least one hydrotrope;

a corrosion inhibiting effective amount of at least one metal corrosion inhibitors;

at least one alkaline builder;

and water;

wherein said at least one surfactant comprises a combination of at least one ethoxylated alcohol and at least one alkyl polyglycoside, and wherein the ratio of said fatty acid methyl ester to said at least one surfactant ranges from about 1:2 to about 1:12.

2. A composition according to claim 1, wherein said hydrotope is selected from the group comprising of alkanolamide, sodium xylene sulfonate, and any combination thereof.

3. A composition according to claim 2, wherein said alkanolamide is capramide diethanolamine.

4. A cleaning composition according to claim 2, wherein said hydrotrope additionally comprises an aliphatic phosphate ester.

5. A cleaning composition according to claim 1, wherein the fatty acid methyl ester is methyl oleate.

6. A cleaning composition according to claim 1, wherein the at least one ethoxylated alcohol is selected from C6-C8 ethoxylated alcohols, C8-C10 ethoxylated alcohols, C9-C11 ethoxylated alcohols, C12-C16 ethoxylated fatty alcohols and combinations thereof.

7. A composition according to claim 1, wherein said at least one ethoxylated alcohol has an HLB from about 11 to about 13.

8. A composition as defined in claim 1, wherein said alkyl polyglycoside has an HLB from about 11 to about 13.

9. A composition according to claim 1, wherein the corrosion inhibitor is selected from the group comprising a modified carboxylic acid derivative, aliphatic phosphate esters, and any combination thereof.

10. A composition according to claim 1, wherein said corrosion inhibitor is present in an amount effective to prevent corrosion on aluminum, magnesium, titanium, and steel.

11. A composition according to claim 1, wherein said pH is less than about 10.0.

12. A composition according to claim 1, wherein said composition remains optically clear and stable at multiple dilutions with water.

13. A composition according to claim 1, wherein said composition conforms to MIL-PRF-87937D.

14. A composition according to claim 1, wherein said composition optionally comprises:

(a) glycol ether, (b) preservatives, (c) stabilizers, (d) defoamers, (e) sequestering agents, (f) builders, or (g) any combination thereof.

15. A method for cleaning exterior surfaces of aircraft, said method comprising:

providing a cleaning composition according to claim 1;

optionally, diluting the cleaning composition;

applying the cleaning composition to the exterior surfaces of the aircraft;

scrubbing the surfaces;

and rinsing the surfaces with water.

16. A composition according to claim 1 wherein the ratio of said fatty acid methyl ester to said at least one surfactant is about 1:10.

17. A composition according to claim 1 wherein said at least one alkaline builder comprises about 0.1 to 1.0 parts by weight of alkali metal silicate.

18. A cleaning composition comprising:

1 to 10 parts by weight of at least one fatty acid methyl ester;

10 to 35 parts by weight of at least one ethoxylated alcohol having an HLB ranging from about 10 to about 14;

1 to 10 parts by weight of at least one alkyl polyglycoside having an HLB ranging from about 10 to about 14;

1-25 parts by weight of at least one hydrotrope;

0.1 to 1 parts by weight of an alkali metal silicate;

0.1 to 2 parts by weight of at least one corrosion inhibitor in an amount effective to prevent corrosion on metals;

and water.

* * * * *